US008498862B2

(12) United States Patent
Okuda et al.

(10) Patent No.: US 8,498,862 B2
(45) Date of Patent: Jul. 30, 2013

(54) SPEECH SIGNAL PROCESSING APPARATUS

(75) Inventors: Kozo Okuda, Hirakata (JP); Kenji Morimoto, Tokyo-to (JP)

(73) Assignees: Sanyo Electric Co, Ltd., Osaka (JP); Sanyo Semiconductor Co., Ltd., Gunma (JP)

( * ) Notice: Subject to any disclaimer, the term of this patent is extended or adjusted under 35 U.S.C. 154(b) by 842 days.

(21) Appl. No.: 12/693,950

(22) Filed: Jan. 26, 2010

(65) Prior Publication Data

US 2010/0191528 A1 Jul. 29, 2010

(30) Foreign Application Priority Data

Jan. 26, 2009 (JP) ..... 2009-14433

(51) Int. Cl.
*G10L 21/00* (2013.01)

(52) U.S. Cl.
USPC ..... 704/225; 704/226; 381/380

(58) Field of Classification Search
USPC ..... 704/225, 226; 381/380
See application file for complete search history.

(56) References Cited

U.S. PATENT DOCUMENTS

| | | | | |
|---|---|---|---|---|
| 2006/0265219 | A1 | 11/2006 | Honda | |
| 2008/0175399 | A1* | 7/2008 | Kim et al. | 381/57 |
| 2008/0298624 | A1* | 12/2008 | Jeong et al. | 381/380 |
| 2009/0097681 | A1* | 4/2009 | Puria et al. | 381/318 |

FOREIGN PATENT DOCUMENTS

| | | | |
|---|---|---|---|
| EP | 0671862 | A1 | 9/1995 |
| JP | 10023122 | A | 1/1998 |
| JP | 2000-261529 | A | 9/2000 |
| JP | 2000-261534 | A | 9/2000 |
| JP | 2001-177635 | A | 6/2001 |
| JP | 2003-009272 | A | 1/2003 |
| JP | 2006-287721 | A | 10/2006 |
| JP | 2006-304260 | A | 11/2006 |

OTHER PUBLICATIONS

Extended European Search Report for Application No. 10151423.0, mailed on Sep. 8, 2010 (12 pages).
Partial European Search Report for Application No. 10151423.0, mailed on May 19, 2010 (5 pages).
Patent Abstracts of Japan for Japanese Publication No. 10-023122, publication date Jan. 23, 1998 (1 page).
Office Action issued in corresponding Japanese Application No. 2009-014433 dated Sep. 18, 2012, and English translation thereof (5 pages).

* cited by examiner

*Primary Examiner* — Daniel D Abebe
(74) *Attorney, Agent, or Firm* — Osha Liang LLP

(57) ABSTRACT

A speech signal processing apparatus includes a control signal output unit configured to receive as an input signal either one of a first speech signal corresponding to a sound uttered by a user and a second speech signal corresponding to a sound output from an eardrum of the user when the user utters a sound, and output a control signal corresponding to a noise level of the input signal, and a speech signal output unit configured to output either one of the first speech signal and the second speech signal according to the control signal.

4 Claims, 15 Drawing Sheets

SPEECH SIGNAL PROCESSING APPARATUS

CROSS-REFERENCE TO RELATED APPLICATION

This application claims the benefit of priority to Japanese Patent Application No. 2009-14433, filed Jan. 26, 2009, of which full contents are incorporated herein by reference.

BACKGROUND OF THE INVENTION

1. Field of the Invention

The present invention relates to a speech signal processing apparatus.

2. Description of the Related Art

If a user does another work while using a mobile phone, the user might use a hands-free set so as to use both hands freely.

As the hands-free set, there are known a head set provided with an earphone and a microphone, an earphone microphone, an earphone microphone of such a type as to receive sound emitted in the ear (See Japanese Patent Laid-Open Publication No. 2006-287721 and Japanese Patent Laid-Open Publication No. 2003-9272) and the like.

In a microphone of the above-mentioned headset provided with an earphone and a microphone and an earphone microphone, a noise around the user might mix into a sound uttered by the user. Thus, in a noisy environment, sound quality during a call is degraded so that even the call itself might become difficult. On the other hand, the earphone microphone of such a type as to receive sound in the ear is worn by the user in the ear, and a sound output from an eardrum of the user is converted into an electric speech signal. Thus, even in the noisy environment, the call itself would not become difficult. However, the sound output from the eardrum is different in frequency characteristics from the sound uttered from the mouth in general, and the sound output from the eardrum becomes a so-called inward sound. As a result, in the case of using the earphone microphone of such a type as to receive the sound in the ear, the sound quality during a call is inferior in general to that in the case of using the headset provided with an earphone and a microphone and an earphone microphone, particularly in a quiet environment.

SUMMARY OF THE INVENTION

A speech signal processing apparatus according to an aspect of the present invention, comprises: a control signal output unit configured to receive as an input signal either one of a first speech signal corresponding to a sound uttered by a user and a second speech signal corresponding to a sound output from an eardrum of the user when the user utters a sound, and output a control signal corresponding to a noise level of the input signal; and a speech signal output unit configured to output either one of the first speech signal and the second speech signal according to the control signal.

Other features of the present invention will become apparent from descriptions of this specification and of the accompanying drawings.

BRIEF DESCRIPTION OF THE DRAWINGS

For more thorough understanding of the present invention and advantages thereof, the following description should be read in conjunction with the accompanying drawings, in which.

DETAILED DESCRIPTION OF THE INVENTION

At least the following details will become apparent from descriptions of this specification and of the accompanying drawings.

<Entire Configuration and First Embodiment of Earphone Microphone LSI>

Figure 1:
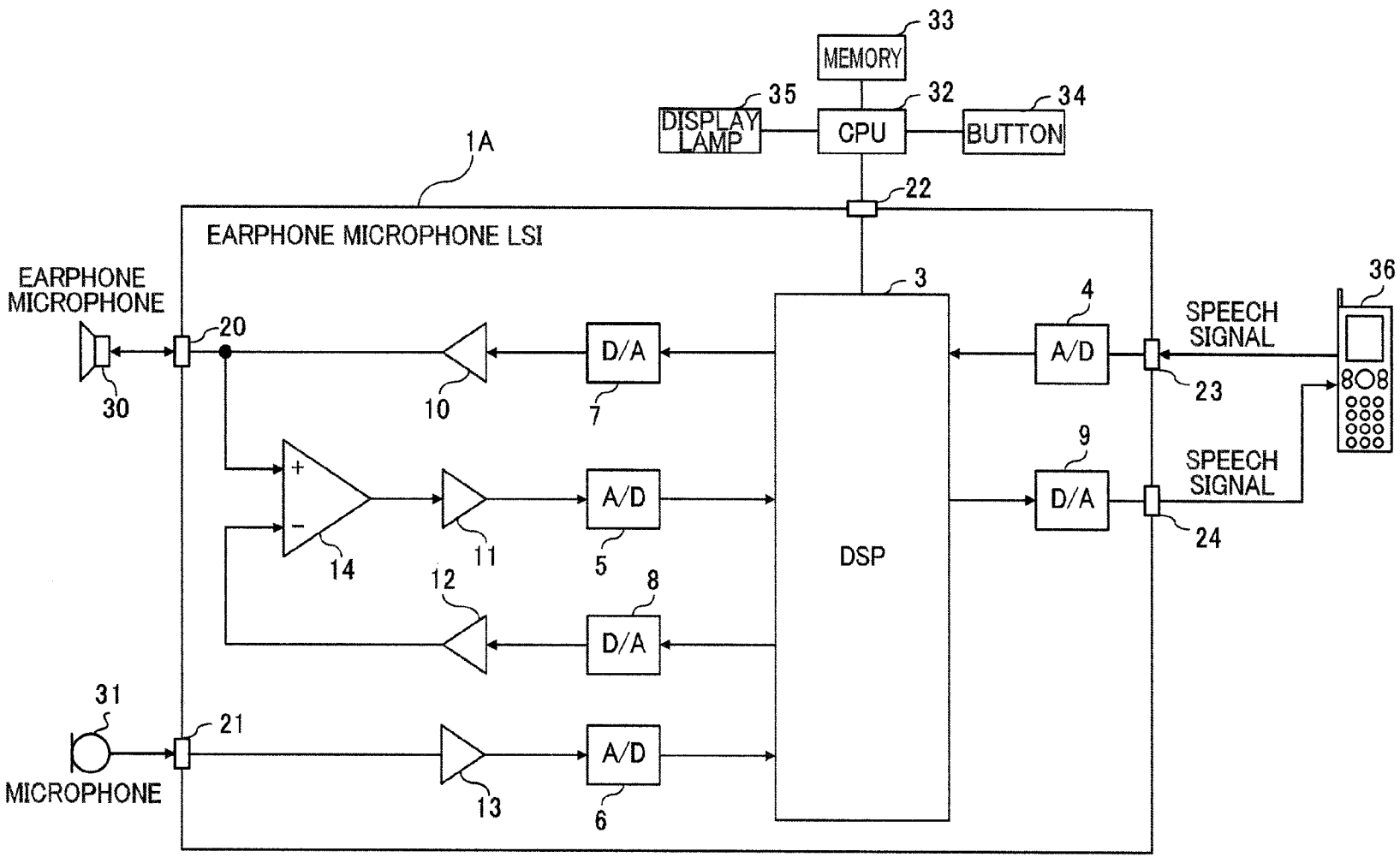
FIG. 1 is a diagram illustrating a configuration of an earphone microphone LSI 1A according to an embodiment of the present invention.

First, a configuration will be described of an earphone microphone LSI according to an embodiment of the present invention. FIG. 1 is a block diagram illustrating a configuration of an earphone microphone LSI 1A according to a first embodiment of the earphone microphone LSI (speech signal processing apparatus).

In an embodiment according to the present invention, it is assumed that a user wears an earphone microphone 30 and a microphone 31 and talks with a far end speaker using a mobile phone 36.

The earphone microphone 30 is an earphone microphone of such a type as to receive sound in the ear. Specifically, the earphone microphone 30 has a speaker function of producing sound by vibrating a diaphragm (not shown) on the basis of a speech signal input from a terminal 20. The earphone microphone 30 also has a microphone function of generating a speech signal by converting vibration of an eardrum when a person wearing the earphone microphone 30 utters a sound into vibration of the diaphragm. This earphone microphone 30, which generates a speech signal corresponding to a sound output from the eardrum, is a known art and is described in Japanese Patent Laid-Open Publication No. 2003-9272, for example. Then, the speech signal generated by the earphone microphone 30 is input to the earphone microphone LSI 1A through the terminal 20. The signal output to the earphone microphone 30 through the terminal 20 is reflected to be input to the earphone microphone LSI 1A from the terminal 20. Here, the above reflected signal is such a signal as to return through the earphone microphone 30, such a signal that the sound output from the earphone microphone 30 is reflected in the ear to be converted by the earphone microphone 30 into a speech signal, and the like, for example. The terminal 20 is not such a terminal that an output signal and an input signal are exclusively input to/output from. For example, an output signal and an input signal might be concurrently input to/output from the terminal 20.

The microphone 31 is a microphone that generates a speech signal by converting a sound uttered by a person wearing the microphone 31 into vibration of a diaphragm (not shown). The speech signal generated by the microphone 31 is input to the earphone microphone LSI 1A through the terminal 21.

A CPU 32 controls the earphone microphone LSI 1A in a centralized manner through a terminal 22 by executing a program stored in a memory 33. For example, the CPU 32 outputs an instruction signal for executing processing of setting a filter coefficient on the basis of an impulse response, which will be described later, to a DSP 3, when turning-on for operating the earphone microphone LSI 1A is detected. Also, a configuration may be made such that the CPU 32 outputs the above-mentioned instruction signal to the DSP 3 in response to an input of a reset signal for resetting the earphone microphone LSI 1A to the earphone microphone LSI 1A, for example.

The memory 33 is a nonvolatile writable storage area such as a flash memory, and stores various data to be required for controlling the earphone microphone LSI 1A other than the program executed by the CPU 32.

A button 34 is one that transmits to the CPU 32 an instruction to start/stop the earphone microphone LSI 1A, for example. The button 34 is also used for transmitting to the CPU 32 an instruction to allow the earphone microphone LSI 1A to measure the impulse response, for example.

A display lamp 35 is a light emitting device made up of an LED (Light Emitting Diode) or the like, and is turned on or blinks by control of the CPU 32. The display lamp 35 is turned on when the earphone microphone LSI 1A is started, and turned off when the operation of the earphone microphone LSI 1A is stopped, for example.

A mobile phone 36 transmits a speech signal of a user output from a terminal 24 to the far end speaker and outputs as a speech signal a received sound of the far end speaker to the terminal 23 of the earphone microphone LSI 1A. The mobile phone 36 and the terminals 23, 24 are connected through a signal line.

Figure 2:
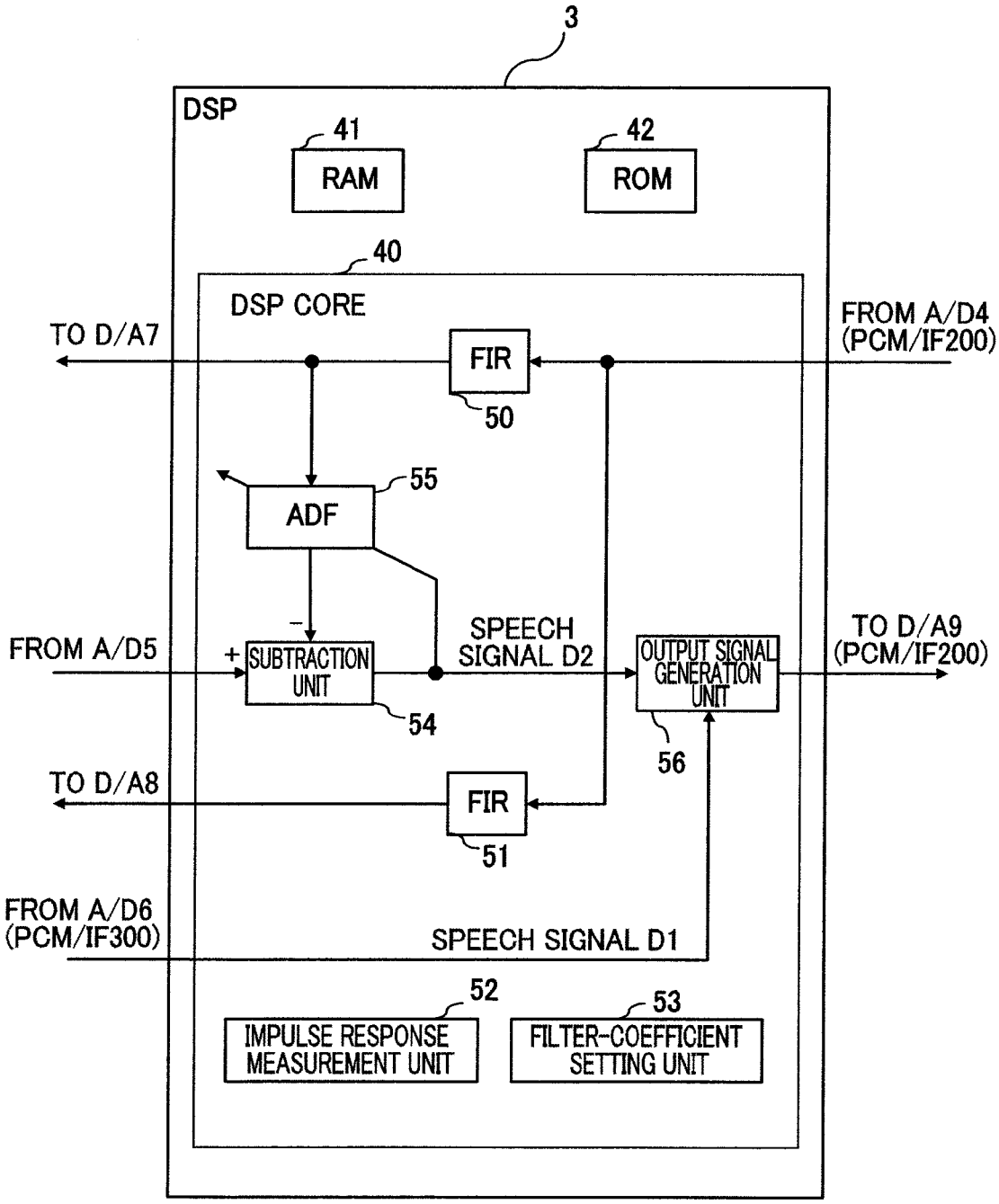
FIG. 2 is a diagram illustrating an embodiment of a DSP 3.

The DSP 3 is, as shown in FIG. 2, includes a DSP core 40, a RAM 41, a ROM 42. FIR filters 50, 51, an impulse response measurement unit 52, a filter-coefficient setting unit 53, a subtraction unit 54, an adaptive filter 55, and an output signal generation unit 56 are realized by execution of the program stored in the RAM 41 or the ROM 42 by the DSP core 40. Filter coefficients of the FIR filters 50, 51 are stored in the RAM 41.

A speech signal from the mobile phone 36 is input to an AD converter 4 through the terminal 23. Then, the AD converter 4 outputs to the DSP 3 a digital signal obtained by performing analog/digital conversion processing for the speech signal. The digital signal input to the DSP 3 is input to each of the FIR filters 50, 51. The FIR filter 50 performs convolution calculation processing for the input digital signal on the basis of the filter coefficient of the FIR filter 50, to be output to a DA converter 7. At the same time, the FIR filter 51 performs the convolution calculation processing for the input digital signal on the basis of the filter coefficient of the FIR filter 51, to be output to a DA converter 8.

The DA converter 7 outputs to an amplification circuit 10 an analog signal obtained by performing digital/analog conversion processing for the output signal from the FIR filter 50. The amplification circuit 10 amplifies the analog signal by a predetermined amplification factor, to be output to a differential amplification circuit 14 at a non-inverting input terminal thereof.

The DA converter 8 outputs to an amplification circuit an analog signal obtained by performing digital/analog conversion processing for the output signal from the FIR filter 51. The amplification circuit 12 amplifies the analog signal by a predetermined amplification factor, to be output to an inverting input terminal of the differential amplification circuit 14.

To the non-inverting input terminal of the differential amplification circuit 14, a signal obtained by combining the analog signal output from the amplification circuit 10 and the analog signal input from the terminal 20 is input, and to the inverting input terminal thereof, the analog signal output from the amplification circuit 12 is input. The differential amplification circuit 14 outputs a signal obtained by amplifying a difference between the analog signal input to the non-inverting input terminal and the analog signal input to the inverting input terminal. The amplification circuit 11 amplifies the output signal of the differential amplification circuit 14 by a predetermined amplification factor, to be output.

An AD converter 5 outputs to the DSP 3 a digital signal obtained by performing analog/digital conversion processing for the analog signal from the amplification circuit 11. The digital signal input to the DSP 3 is subjected to echo removing processing at the subtraction unit 54, to be output to the output signal generation unit 56.

An amplification circuit 13 amplifies a speech signal from the microphone 31 input through the terminal 21 by a predetermined amplification factor. An AD converter 6 inputs to the DSP 3 a digital signal obtained by performing analog/digital conversion processing for the analog signal from the amplification circuit 13. The digital signal input to the DSP 3 is output to the output signal generation unit 56.

The impulse response measurement unit 52 measures an impulse response from the AD converter 5 when an impulse is generated in the output of the FIR filter 50 and an impulse response from the AD converter 5 when an impulse is generated in the output of the FIR filter 51. The filter-coefficient setting unit 53 sets the filter coefficients of the FIR filters 50, 51 on the basis of the impulse responses measured by the impulse response measurement unit 52 so that a signal obtained by combining the output signal of the amplification circuit 10 and such a signal that the output signal of the amplification circuit 10 is reflected through the earphone microphone 20 and returns, that is, an echo is removed or attenuated at the differential amplification circuit 14 using the output signal of the amplification circuit 12.

The subtraction unit 54 subtracts a signal output from the adaptive filter 55 from the signal input from the AD converter 5, to be output. The signal output from the FIR filter 50 and the output signal of the subtraction unit 54 are input to the adaptive filter 55. To the adaptive filter 55, a speech signal from the far end speaker output from the FIR filter 50 is transmitted, and in a state where a person wearing the earphone microphone 30 is not speaking, the filter coefficient is adaptively changed so that the signal output from the subtraction unit 54 becomes a predetermined level or less. Since the echo is removed or attenuated at the subtraction unit 54 as above, a speech signal generated by the microphone function of the earphone microphone 30 is output from the subtraction unit 54. The configuration of the adaptive filter 55 and the operation of setting the filter coefficient can be made similar to the configuration and operation of the adaptive filter disclosed in Japanese Patent Laid-Open Publication No. 2006-304260, for example.

To the output signal generation unit 56, a speech signal from the earphone microphone 30 output from the subtraction unit 54 and a speech signal from the microphone 31 output from the AD converter 6 are input. Then, the output signal generation unit 56 outputs either one of the speech signals input thereto, for example, according to a noise level of the speech signal from the microphone 31.

In such earphone microphone LSI 1A, the speech signal input to the AD converter 4 is output to the earphone microphone 30 through the terminal 20, the diaphragm of the earphone microphone 30 is vibrated, and a sound is output. Also, the generated echo is removed or attenuated by the differential amplification circuit 14, the subtraction unit 54, and the adaptive filter 55. If the echo cannot be completely removed, a signal containing the attenuated echo is output. If the user wearing the earphone microphone 30 and the microphone 31 utters a sound, the diaphragm of the earphone microphone 30 and the diaphragm of the microphone 31 are vibrated, and the speech signals are generated, respectively. The speech signal generated by the earphone microphone 30 is input to the DSP3 through the terminal 20, and as a result, input to the output signal generation unit 56. Also, the speech signal generated by the microphone 31 is input to the DSP 3 through the terminal 21, and as a result, input to the output signal generation unit 56. Then, the output signal generation unit 56 selects either the speech signal from the earphone microphone 30 or the speech signal of the microphone 31, for example, on the basis of the noise level of the speech signal of the microphone 31, that is, the noise level around the user. The selected speech signal is converted by the DA converter 9 into an analog signal, and then, input to the mobile phone 36 through the terminal 24, and thus, it is transmitted to the far end speaker. Here, the speech signal corresponding to the sound input to the microphone 31, that is, the speech signal subjected to digital-conversion by the AD converter 6 is called a speech signal D1. Also, the speech signal corresponding to the sound input to the earphone microphone 30, that is, the speech signal which is subjected to digital-conversion by the AD converter 5 and in which echo is attenuated or removed by the subtraction unit 54 is called a speech signal D2. Also, the measuring of the impulse response and the setting of the filter coefficient can be performed by the method similar to that disclosed in Japanese patent Laid-Open Publication No. 2006-304260, for example.

<First Embodiment of Output Signal Generation Unit>

Figure 3:
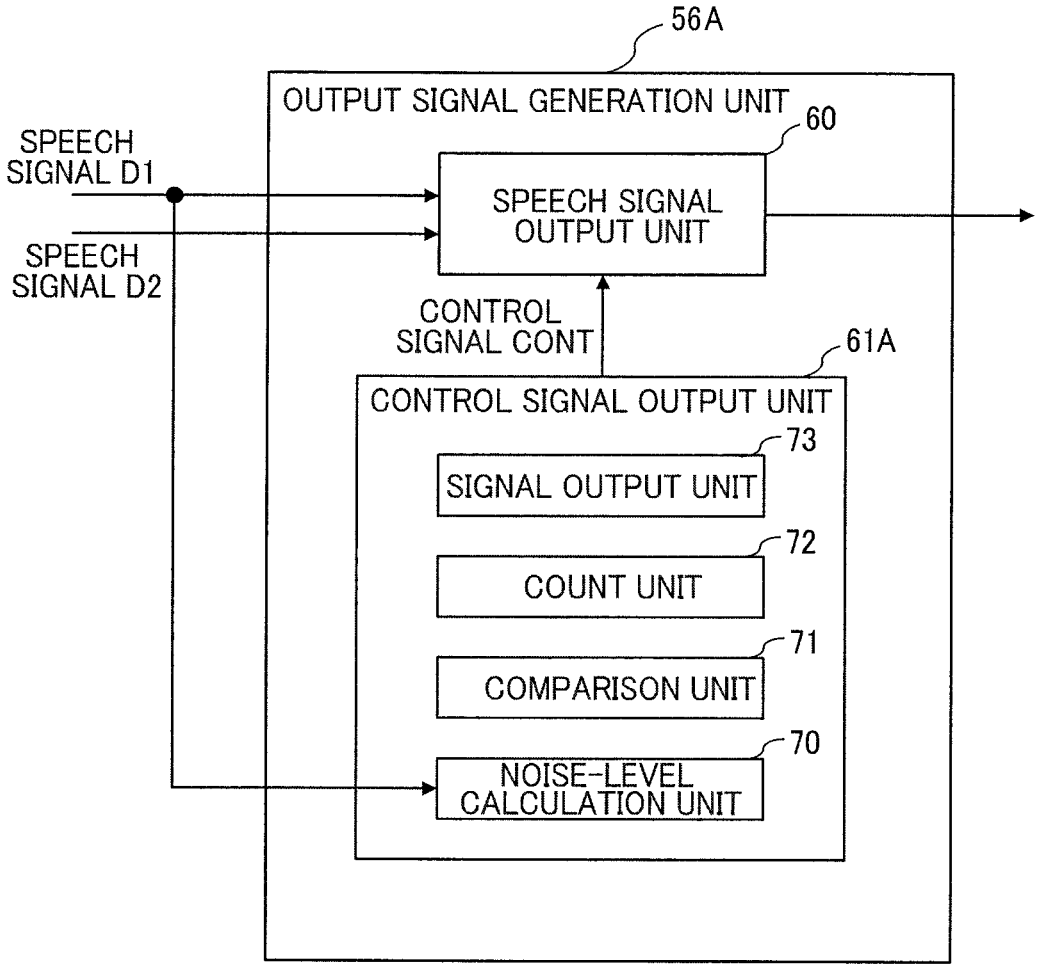
FIG. 3 is a diagram illustrating a configuration of an output signal generation unit 56A.
Figure 4:
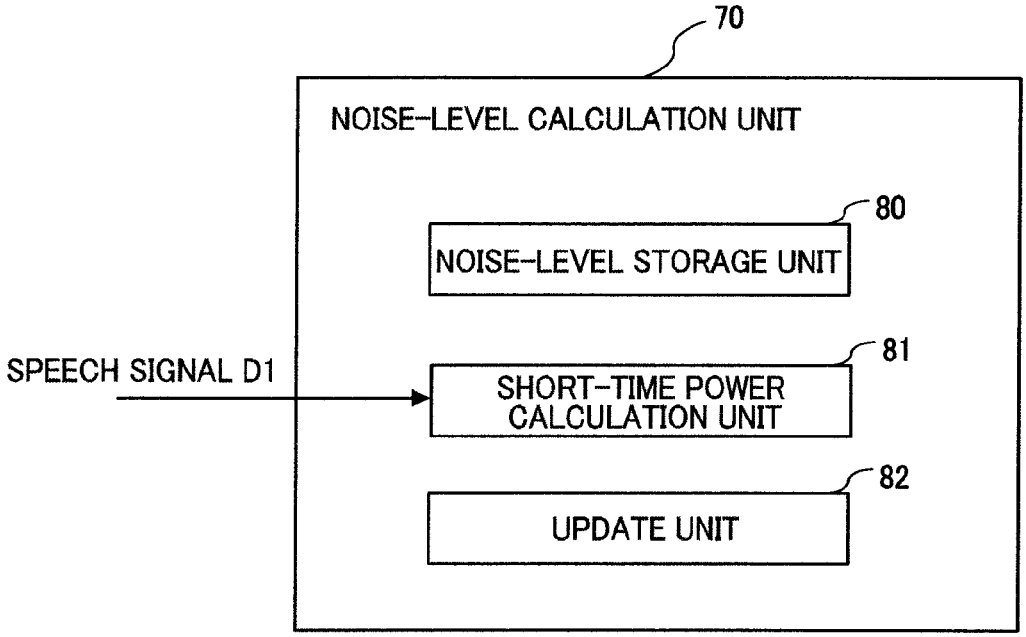
FIG. 4 is a diagram illustrating a configuration of a noise-level calculation unit 70.

Subsequently, details of the output signal generation unit 56 according to an embodiment will be described. FIG. 3 is a block diagram illustrating a configuration of an output signal generation unit 56A according to a first embodiment of the output signal generation unit 56. The output signal generation unit 56A outputs either a speech signal D1 or a speech signal D2 according to a noise level around a user.

A speech signal output unit 60 outputs either the speech signal D1 according to the sound input to the microphone 31 or the speech signal D2 according to the sound input to the earphone microphone 30 on the basis of a control signal CONT. Specifically, if the control signal CONT is at a low level (hereinafter referred to as L level), for example, the speech signal D1 is output, and if the control signal CONT is at a high level (hereinafter referred to as H level), for example, the speech signal D2 is output.

A control signal output unit 61A changes the control signal CONT on the basis of a noise level of the speech signal D1, that is, the noise level around the user detected by the microphone 31. A comparison unit 71, a count unit 72, and a signal output unit 73 according to an embodiment of the present invention correspond to a control signal generation unit, and the count unit 72 and the signal output unit 73 correspond to a generation unit.

A noise-level calculation unit 70 calculates a noise level Np of the input speech signal D1. A noise-level storage unit 80 stores the calculated noise level Np. A short-time power calculation unit 81 calculates a short-time power Pt at a time t by a calculation formula as shown in the below (1), for example:

$$P_t = \frac{\sum_{i=0}^{N-1} |D1_{t-i}|}{N} \tag{1}$$

Here, Pt is the short-time power at the time t as mentioned above, and D1*t* is the speech signal D1 at the time t. That is, the short-time power Pt according to an embodiment of the present invention is defined as an average of absolute values of the speech signals D1 of N samples from the time t in the past. The short-time power Pt according to an embodiment of the present invention is calculated on the basis of the above equation (1), but this is not limitative. Instead of the average of the absolute values of the speech signals D1, a square sum or the square-root of square sum of the speech signal D1 may be used, for example.

An update unit 82 compares the calculated short-time power Pt and the noise level Np stored in the noise-level storage unit 80. If the short-time power Pt is lower than the noise level Np, the update unit 82 subtracts a predetermined correction value N1 from the noise level Np in order to lower the noise level Np. Then, the update unit 82 stores the subtracted noise level Np in the noise-level storage unit 80. On the other hand, if the short-time power Pt is higher than the noise level Np, the update unit 82 adds a predetermined correction value N2 to the noise level Np in order to raise the noise level Np. Then, the update unit 82 stores the added noise level Np in the noise-level storage unit 80. As mentioned above, each time the update unit 82 compares the short-time power Pt and the noise level Np, the update unit updates the noise level Np.

The comparison unit 71 compares the noise level Np and a threshold value P1 at a predetermined level when the noise level Np is updated to output a comparison result.

A count unit 72 changes the count value on the basis of the comparison result each time the comparison unit 71 compares the noise level Np and the threshold value P1. Specifically, if the comparison unit 71 outputs a comparison result indicating that the noise level Np is higher than the threshold value P1, the count unit 72 increments the count value only by "1", for example. On the other hand, if the comparison unit 71 outputs the comparison result indicating that the noise level Np is lower than the threshold value P1, the count unit 72 clears the count value to zero. Then, if the count value becomes higher than a predetermined count value C, the count unit 72 allows the signal output unit 73 to output the control signal CONT of the H-level. On the other hand, if the count value is equal to the predetermined count value C or less, the count unit 72 allows the signal output unit 73 to output the control signal CONT of the L-level.

The signal output unit 73 outputs to the speech signal output unit 60 the control signal CONT on the basis of the count value of the count unit 72, as mentioned above.

Figure 5:
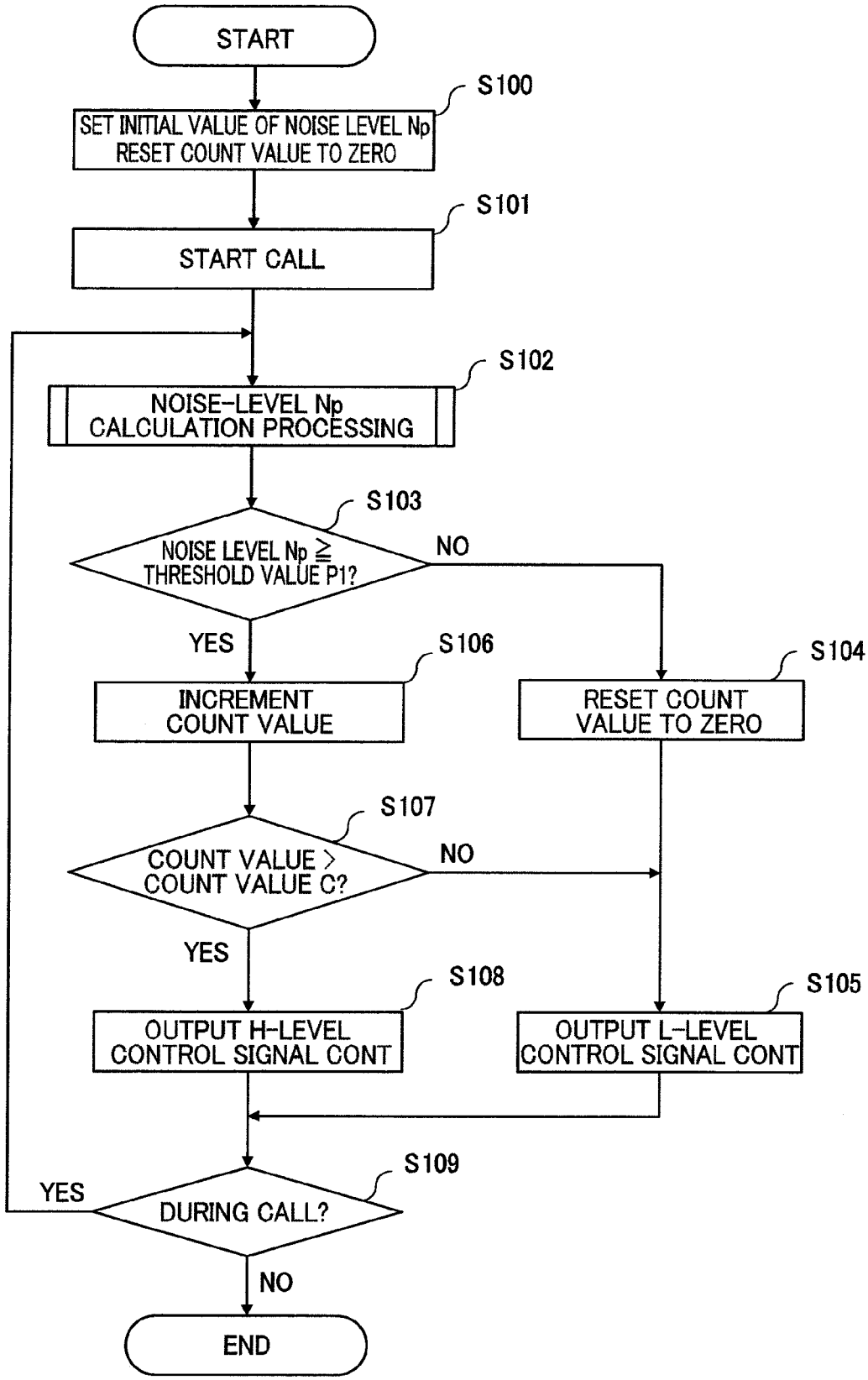
FIG. 5 is a flowchart illustrating an example of processing when an output signal generation unit 56A outputs a speech signal.

Subsequently, details of an operation when the output signal generation unit 56A outputs a speech signal will be described. FIG. 5 is a flowchart illustrating an example of processing when the output signal generation unit 56A according to an embodiment of the present invention outputs a speech signal. Here, it is assumed that the earphone microphone LSI 1A measures the above-mentioned impulse response and setting of the filter coefficient when started.

Figure 6:
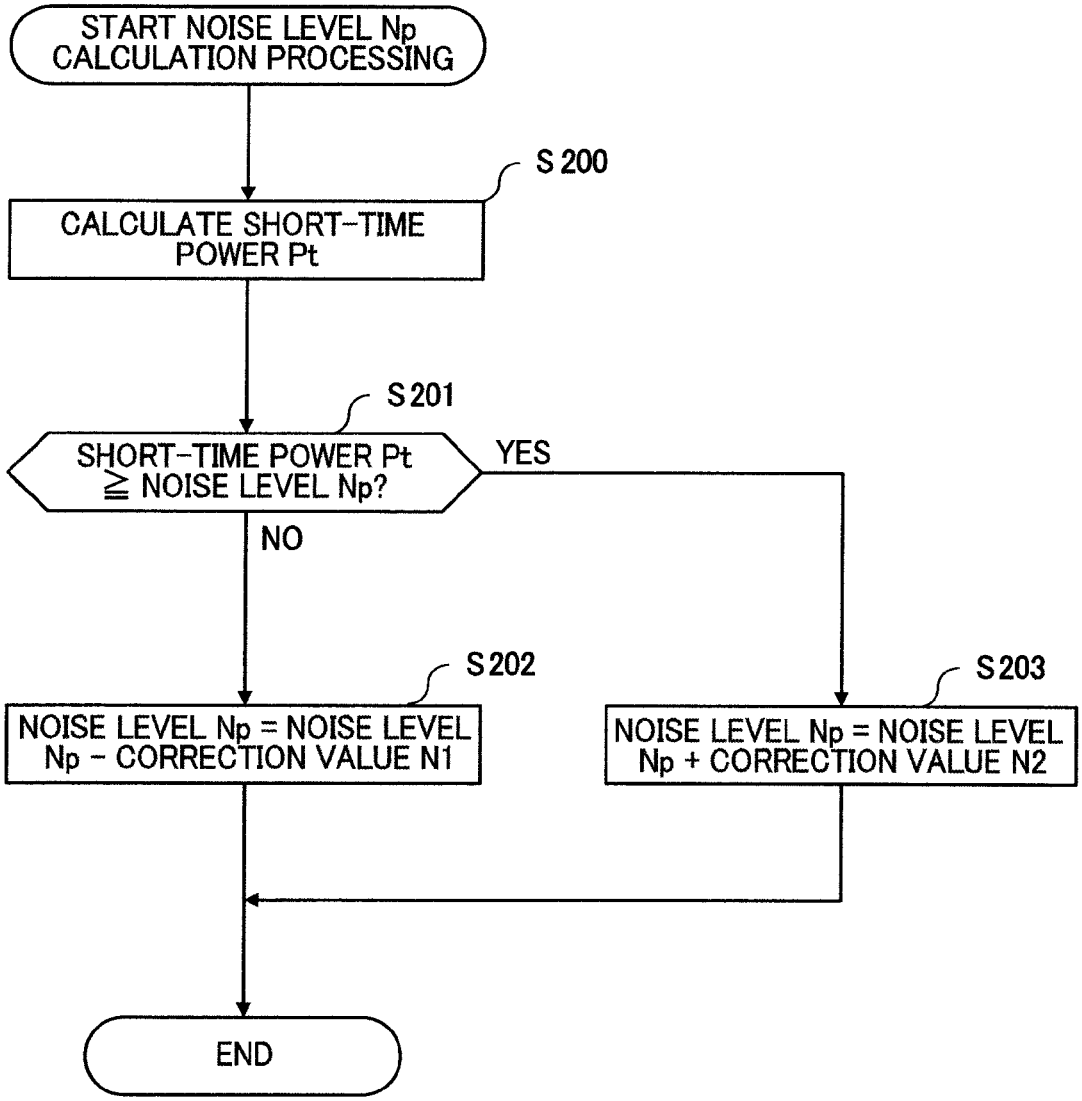
FIG. 6 is a flowchart illustrating an example of processing when a noise-level calculation unit 70 calculates a noise level Np.

First, if the user operates the button 34 in order to start the earphone microphone LSI 1A, the earphone microphone LSI 1A is started on the basis of an instruction from the CPU 32. And if the earphone microphone LSI 1A is started, the short-time power calculation unit 81 calculates the short-time power Pt and stores the calculated short-time power Pt in the noise-level storage unit 80 as the initial noise level Np (S100). Here, a calculation result of the short-time power calculation unit 81 is the initial noise level Np, but it may be so configured that if the earphone microphone LSI 1A is started, a predetermined value is stored in the noise-level storage unit 80 as the initial noise level Np. Also, the count unit 72 clears the count value to zero (S100). Then, the user operates the mobile phone 36 to start a call (S101). Subsequently, the noise-level calculation unit 70 performs calculation processing of the noise level Np during the call (S102). Here, an example of the calculation processing of the noise level Np in step S102 will be described referring to a flowchart shown in FIG. 6. First, the short-time power calculation unit 81 calculates the short-time power Pt (S200). Then, the update unit 82 compares the calculated short-time power Pt and the noise level Np stored in the noise-level storage unit 80 (S201). If the calculated short-time power Pt is lower than the noise level Np (S201: NO), the update unit 82 subtracts the correction value N1 from the current noise level Np stored in the noise-level storage unit 80 (S202). On the other hand, if the calculated short-time power Pt is higher than the noise level Np (S201: YES), the update unit 82 adds the correction value N2 to the current noise level Np stored in the noise-level storage unit 80 (S203). As a result, if either the processing S202 or S203 is performed, the noise level Np is updated. In an embodiment of the present invention, the correction value N1 is set greater than the correction value N2. Thus, a variation width when the noise level Np is made higher is smaller than a variation width when the noise level Np is made lower, for example. Therefore, when the short-time power calculation unit 81 calculates the short-time power Pt, for example, even if a sound is detected and the short-time power Pt becomes higher than the noise level Np, the noise level Np is not immediately raised to a large extent. On the other hand, if the short-time power Pt becomes lower than the noise level Np, the noise level Np is lowered to a large extent. Thus, in an embodiment of the present invention, it is possible to calculate the noise level Np around the user with accuracy on the basis of the speech signal D1. If the processing in steps S202 and S203 is performed, the comparison unit 71 compares the updated noise level Np in the noise-level storage unit 80 and the threshold value P1 at a predetermined level (S103). If the noise level Np is lower than the threshold value P1 (S103: NO), the count unit 72 clears the count value to zero (S104), and the signal output unit 73 outputs the control signal CONT of the L-level on the basis of the count value of the count unit 72 (S105). As a result, the speech signal output unit 60 selects the speech signal D1 out of the speech signal D1 and the speech signal D2, to be output.

If the noise level Np is higher than the threshold value P1 (S103: YES), the count unit 72 increments the count value only by "1" (S106). Then, if the count value of the count unit 72 is equal to the predetermined count value C or less (S107: NO), the signal output unit 73 outputs the control signal CONT of the L-level on the basis of the count value (S105). Thus, similarly to the above, the speech signal D1 is output from the speech signal output unit 60. On the other hand, as the result of such increment of the count value only by "1" by the count unit 72 (S106), if the count value of the count unit 72 becomes greater than the predetermined count value C (S107: YES), the signal output unit 73 outputs the control signal CONT of the H-level. Consequently, the speech signal output unit 60 selects the speech signal D2 to be output. After the above-mentioned processing S105 and S108 is finished, if the user continues the call (S109: YES), the DSP 3 repeats the above-mentioned processing S102 to S109. On the other hand, if the user finishes the call (S109: NO) and operates the button 34 in order to stop the earphone microphone LSI 1A, for example, the above-mentioned processing (S102 to S109) is finished.

<Second Embodiment of Output Signal Generation Unit>

Figure 7:
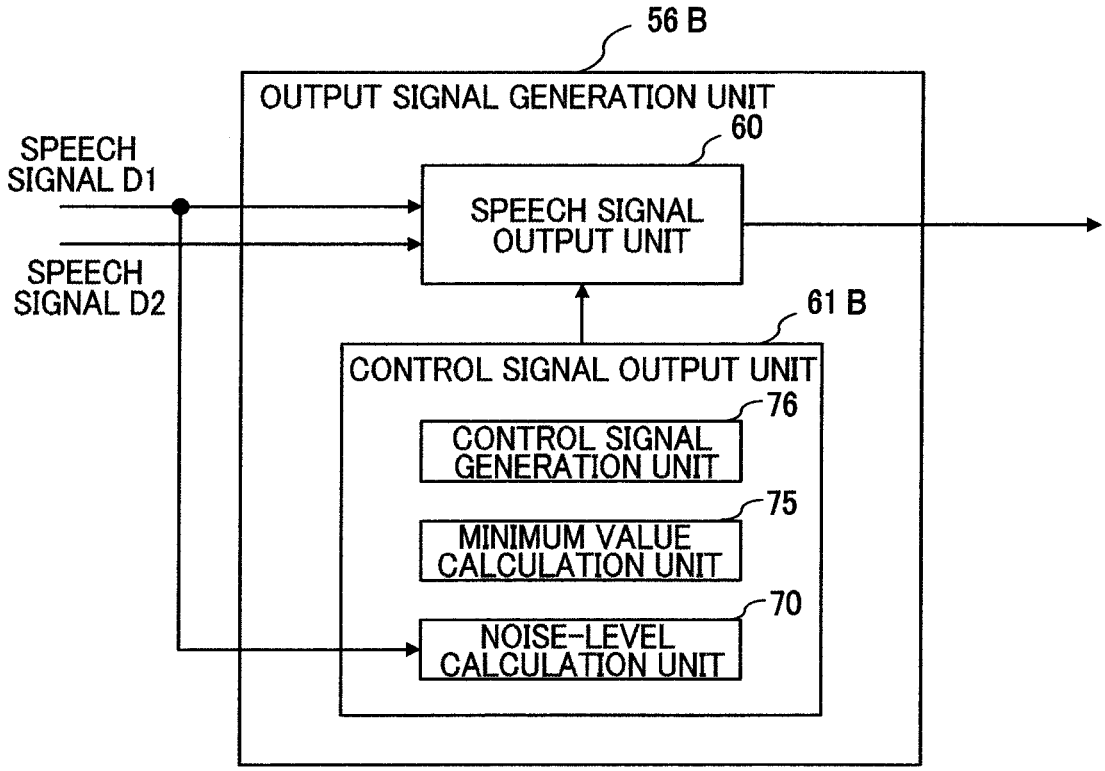
FIG. 7 is a diagram illustrating a configuration of an output signal generation unit 56B.

Here, an output signal generation unit 56B will be described which is a second embodiment of the output signal generation unit 56 according to an embodiment of the present invention. FIG. 7 is a block diagram illustrating a configuration of the output signal generation unit 56B. The speech signal output unit 60 in the output signal generation unit 56B is the same as the speech signal output unit 60 in the output signal generation unit 56A. Therefore, the speech signal output unit 60 outputs the speech signal D1 on the basis of the control signal CONT of the L-level and outputs the speech signal D2 on the basis of the control signal CONT of the H-level.

The control signal output unit 61B changes the control signal CONT on the basis of the noise level of the speech signal D1.

A minimum value calculation unit 75 calculates a minimum value Pmin of the noise level Np in a predetermined time period T1. Here, the short-time power calculation unit 81 according to an embodiment of the present invention calculates the short-time power Pt by sampling N number of the speech signals D1 in the predetermined time period T1. Thus, the minimum value calculation unit 75 calculates the minimum value Pmin of the noise level Np in the predetermined time period T1 from the absolute values of the N number of the speech signals D1. Specifically, the minimum value calculation unit 75 calculates a minimum value of the absolute values of N number of the speech signals D1 as the minimum value Pmin of the noise level Np. The above-mentioned predetermined time period T1 is determined considering a time period of breathing or the like during the call by the user, that is, a time period during which there is no sound uttered by the user in the microphone 31, or the like.

A control signal generation unit 76 compares the minimum value Pmin of the noise level Np and a predetermined threshold value P2 to change the control signal CONT according to such comparison result. Specifically, the control signal generation unit 76 outputs the control signal CONT of the H-level if the minimum value Pmin is equal to the threshold value P2 or more. On the other hand, the control signal generation unit 76 outputs the control signal CONT of the L-level if the minimum value Pmin is lower than the threshold value P2.

Figure 8:
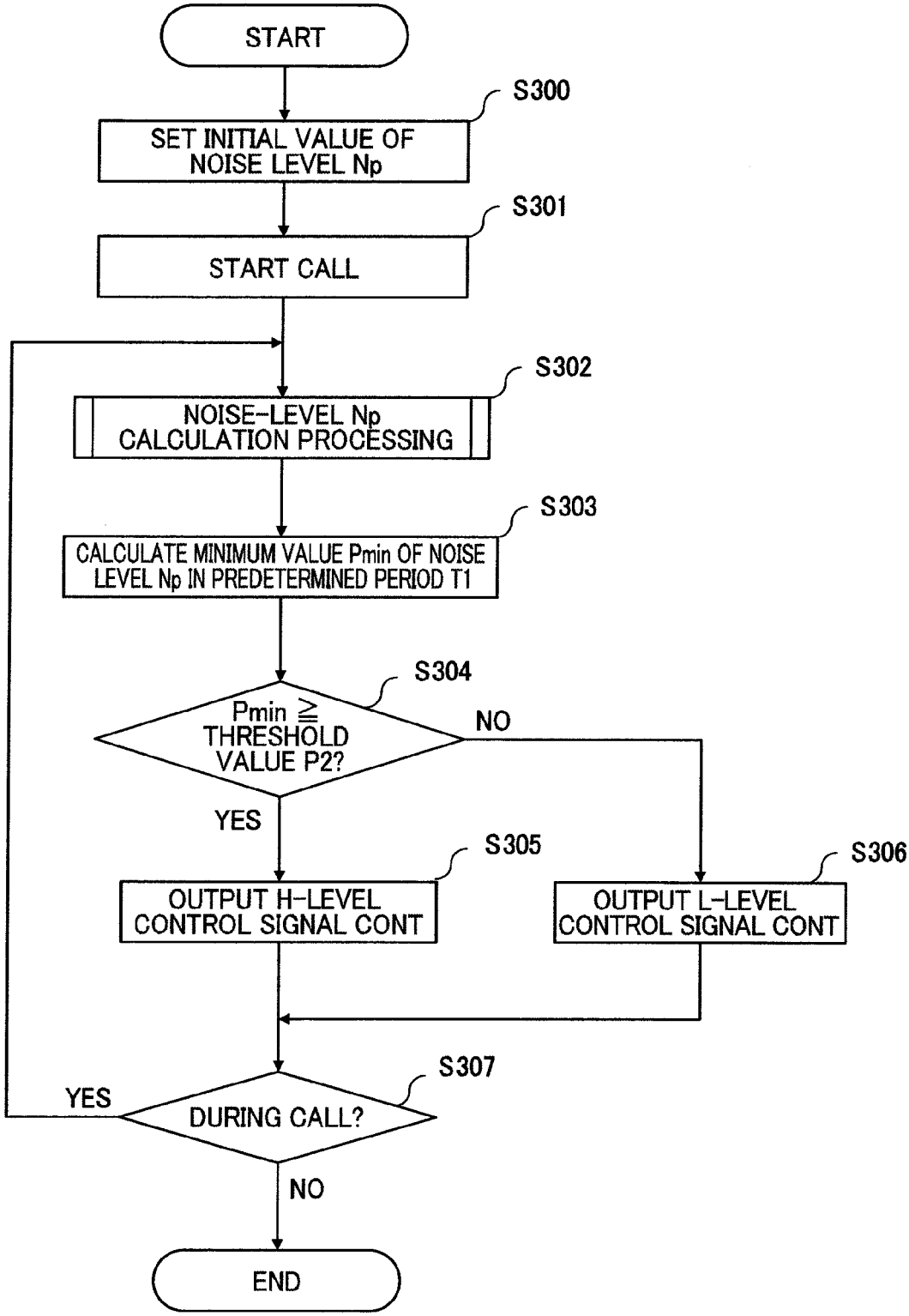
FIG. 8 is a flowchart illustrating an example of processing when an output signal generation unit 56B outputs a speech signal.

Subsequently, details of an operation when the output signal generation unit 56B outputs the speech signal will be described. FIG. 8 is a flowchart illustrating an example of processing when the output signal generation unit 56B according to an embodiment of the present invention outputs the speech signal. Here, the earphone microphone LSI 1A measures the above-mentioned impulse response and setting of the filter coefficient when started.

First, if the user operates the button 34 in order to start the earphone microphone LSI 1A, the earphone microphone LSI 1A is started on the basis of an instruction from the CPU 32. And if the earphone microphone LSI 1A is started, the short-time power calculation unit 81 calculates the short-time power Pt and stores the calculated short-time power Pt in the noise-level storage unit 80 as the initial noise level Np (S300). Then, the user operates the mobile phone 36 to start a call (S301). Subsequently, the noise-level calculation unit 70 performs calculation processing of the noise level Np during the call (S302). The calculation processing (S302) of the noise level Np is the same as the above-mentioned processing S200 to S203 shown in FIG. 6. Then, the minimum value calculation unit 75 calculates the minimum value Pmin of the noise level in the predetermined time period T1 (S303). The control signal generation unit 76 compares the calculated minimum value Pmin and the threshold value P2 (S304). If the minimum value Pmin is higher than the threshold value P2 (S304: YES), that is, noise around the user increases so that the minimum value Pmin of the noise level of the speech signal D1 is higher than the threshold value P2, the control signal generation unit 76 outputs the control signal CONT of the H-level (S305). As a result, the speech signal D2 corresponding to the sound from the earphone microphone 30 is output from the speech signal output unit 60.

On the other hand, if the minimum value Pmin is lower than the threshold value P2 (S304: NO), that is, the surroundings of the user is quiet and the minimum value Pmin of the noise level of the speech signal D1 is lower than the threshold value P2, the control signal generation unit 76 outputs the control signal CONT of the L-level (S306). As a result, the speech signal D1 corresponding to the sound from the microphone 31 is output from the speech signal output unit 60.

After the above-mentioned processing S305 and S306 is finished, if the user continues the call (S307: YES), the DSP 3 repeats the above-mentioned processing S302 to S306. On the other hand, if the user finishes the call (S307: NO) and operates the button 34 in order to stop the earphone microphone LSI LA, for example, the above-mentioned processing (S302 to S307) is finished.

<Third Embodiment of Output Signal Generation Unit>

Here, an output signal generation unit 56C will be described, which is a third embodiment of the output signal generation unit 56 according to an embodiment of the present invention.

Figure 9:
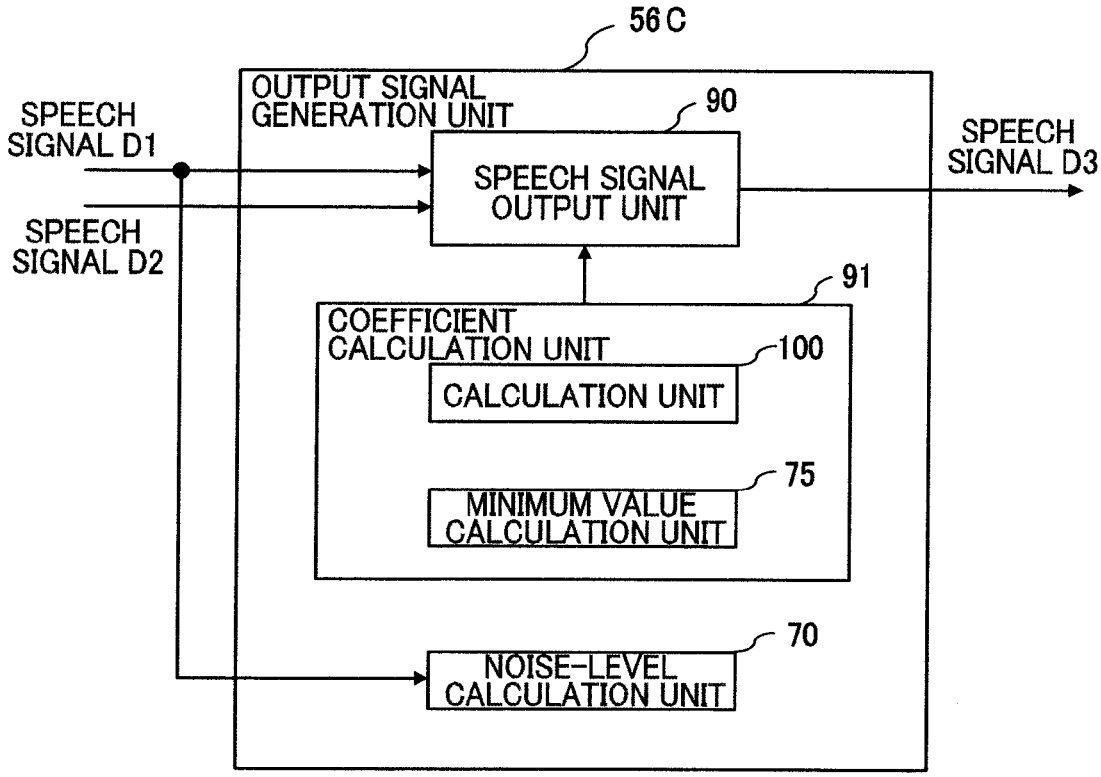
FIG. 9 is a diagram illustrating a configuration of an output signal generation unit 56C.

FIG. 9 is a block diagram illustrating a configuration of the output signal generation unit 56C.

The noise-level calculation unit 70 is the same as the noise-level calculation unit 70 in the above-mentioned output signal generation unit 56A.

A speech signal output unit 90 multiplies the speech signal D2 and the speech signal D1 by a coefficient $\beta$ ($0 \leqq \beta \leqq 1$) and a coefficient ($\beta-1$) calculated by a coefficient calculation unit 91, which will be described later, respectively, and adds the multiplication results together to be output. Thus, a speech signal D3 output from the speech signal output unit 90 is expressed by the speech signal D3=speech signal D2$\times\beta+$speech signal D1$\times(1-\beta)$. The coefficient $\beta$ corresponds to a second coefficient, and the coefficient ($1-\beta$) corresponds to a first coefficient.

The coefficient calculation unit 91 includes the minimum value calculation unit 75 and a calculation unit 100. The minimum value calculation unit 75 is the same as the minimum value calculation unit 75 in the above-mentioned output signal generation unit 56B. Thus, the minimum value Pmin of the noise level Np is calculated by the minimum value calculation unit 75.

The calculation unit 100 multiplies the minimum value Pmin of the noise level Np by a predetermined coefficient $\alpha$ in order to calculate the above-mentioned coefficient $\beta$. That is, in an embodiment of the present invention, the coefficient $\beta$, the predetermined coefficient $\alpha$, and the minimum value Pmin have a relation expressed by $\beta=\alpha\times$Pmin. The coefficient $\alpha$ in an embodiment of the present invention is such a value that satisfies $\alpha\times$Pmin1=1.0 where the minimum value Pmin1 is calculated in the noise where it is difficult for the user to have a conversation using the microphone 31, for example. Thus, if the minimum value Pmin of the noise level Np becomes smaller than the above mentioned minimum value Pmin1, for example, the coefficient $\beta$ becomes smaller as well. On the other hand, if the minimum value Pmin of the noise level Np becomes greater than the above-mentioned minimum value Pmin1, the coefficient $\beta$ becomes greater. However, in an embodiment of the present invention, since the maximum value of the coefficient $\beta$ is set at 1, if the coefficient $\beta$ becomes greater than 1, the calculation unit 100 sets the coefficient $\beta$ at 1.

Thus, if the noise level around the user becomes higher, for example, the coefficient $\beta$ becomes greater, and therefore, a proportion of the speech signal D2 corresponding to the sound of the earphone microphone 30 becomes greater in the speech signal D3 output from the speech signal output unit 90. On the other hand, if the noise level around the user becomes lower, the coefficient $\beta$ becomes smaller, and therefore, the proportion of the speech signal D1 corresponding to the sound of the microphone 31 becomes greater in the speech signal D3.

Figure 10:
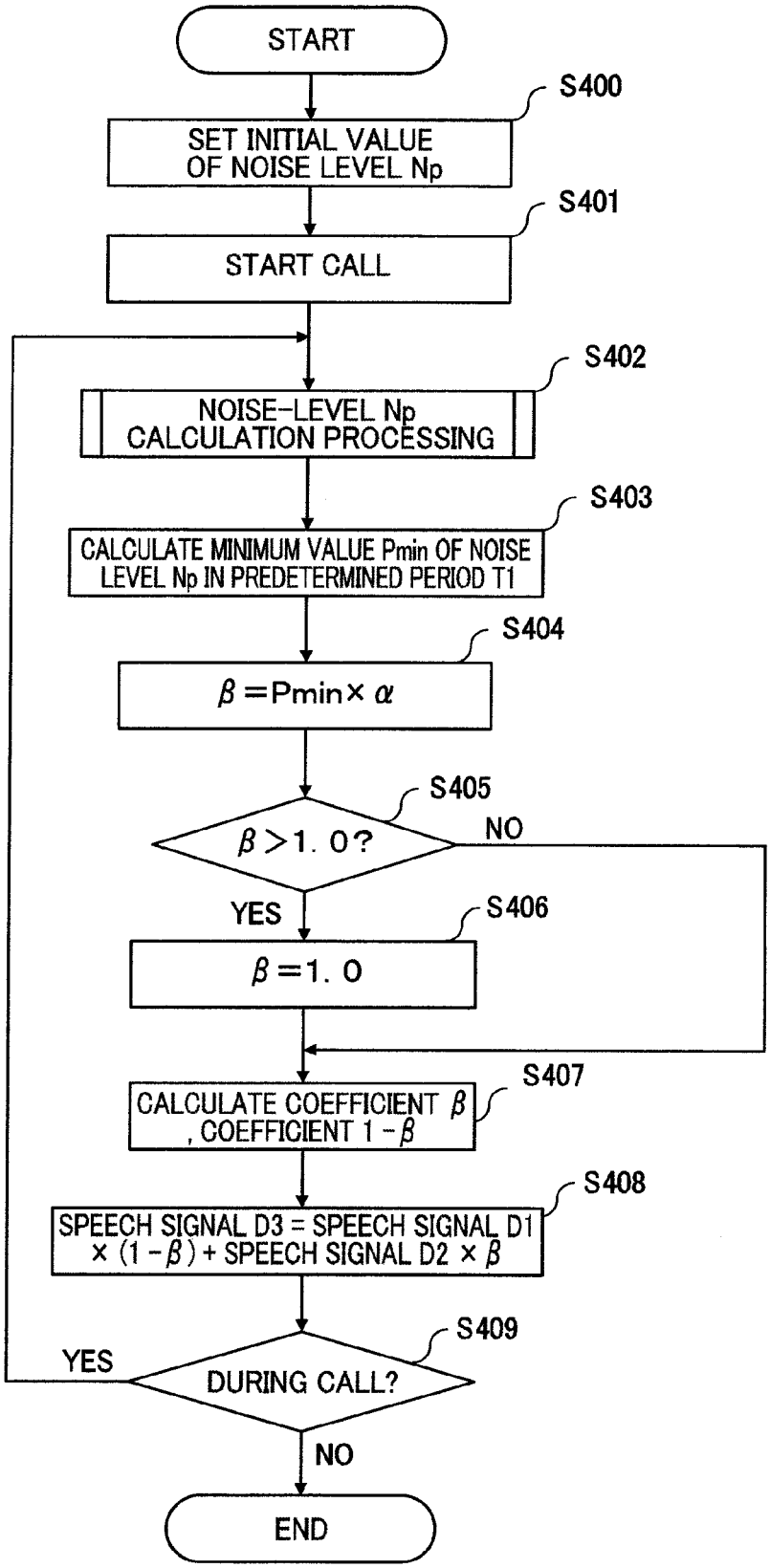
FIG. 10 is a flowchart illustrating an example of processing when an output signal generation unit 56C outputs a speech signal.

Subsequently, details of an operation when the output signal generation unit 56C outputs the speech signal D3 will be described. FIG. 10 is a flowchart illustrating an example of processing when the output signal generation unit 56C according to an embodiment of the present invention outputs the speech signal D3. Here, the earphone microphone LSI 1A measures the above-mentioned impulse response and setting of the filter coefficient when started.

First, if the user operates the button 34 in order to start the earphone microphone LSI 1A, the earphone microphone LSI 1A is started on the basis of an instruction from the CPU 32. And if the earphone microphone LSI 1A is started, the short-time power calculation unit 81 calculates the short-time power Pt and stores the calculated short-time power Pt in the noise-level storage unit 80 as the initial noise level Np (S400). Then, the user operates the mobile phone 36 to start a call (S401). Subsequently, the noise-level calculation unit 70 performs calculation processing of the noise level Np during the call (S402). The calculation processing (S402) of the noise level Np is the same as the above-mentioned processing S200 to S203 shown in FIG. 6. Then, the minimum value calculation unit 75 calculates the minimum value Pmin of the noise level in the predetermined time period T1 (S403). If the minimum value Pmin is calculated, the calculation unit 100 calculates the coefficient $\beta$ by multiplying the calculated minimum value Pmin by the predetermined coefficient $\alpha$ (S404). Then, if the coefficient $\beta$ calculated by the calculation unit 100 is greater than 1 (S405: YES), that is, the noise level in the surroundings is extremely great, the calculation unit 100 sets the coefficient β at 1 (S406). Then, the calculation unit calculates the coefficient β and the coefficient (1−β (S407). On the other hand, if the coefficient β calculated by the calculation unit 100 is smaller than 1 (S405: NO), the calculation unit 100 calculates the coefficient β and the coefficient (1−β) (S407). If the calculation unit 100 performs the processing S407, the speech signal output unit 90 adds the multiplication result obtained by multiplying the speech signal D2 by the coefficient β and the multiplication result obtained by multiplying the speech signal D1 by the coefficient (1−β) together, to be output as the speech signal D3 (S408).

After the above-mentioned processing S408 is finished, if the user continues the call (S409: YES), the DSP 3 repeats the above-mentioned processing S402 to S409. On the other hand, if the user finishes the call (S409: NO) and operates the button 34 in order to stop the earphone microphone LSI 1A, for example, the above-mentioned processing S402 to S409 is finished.

<Entire Configuration and Second Embodiment of Earphone Microphone LSI>

Figure 11:
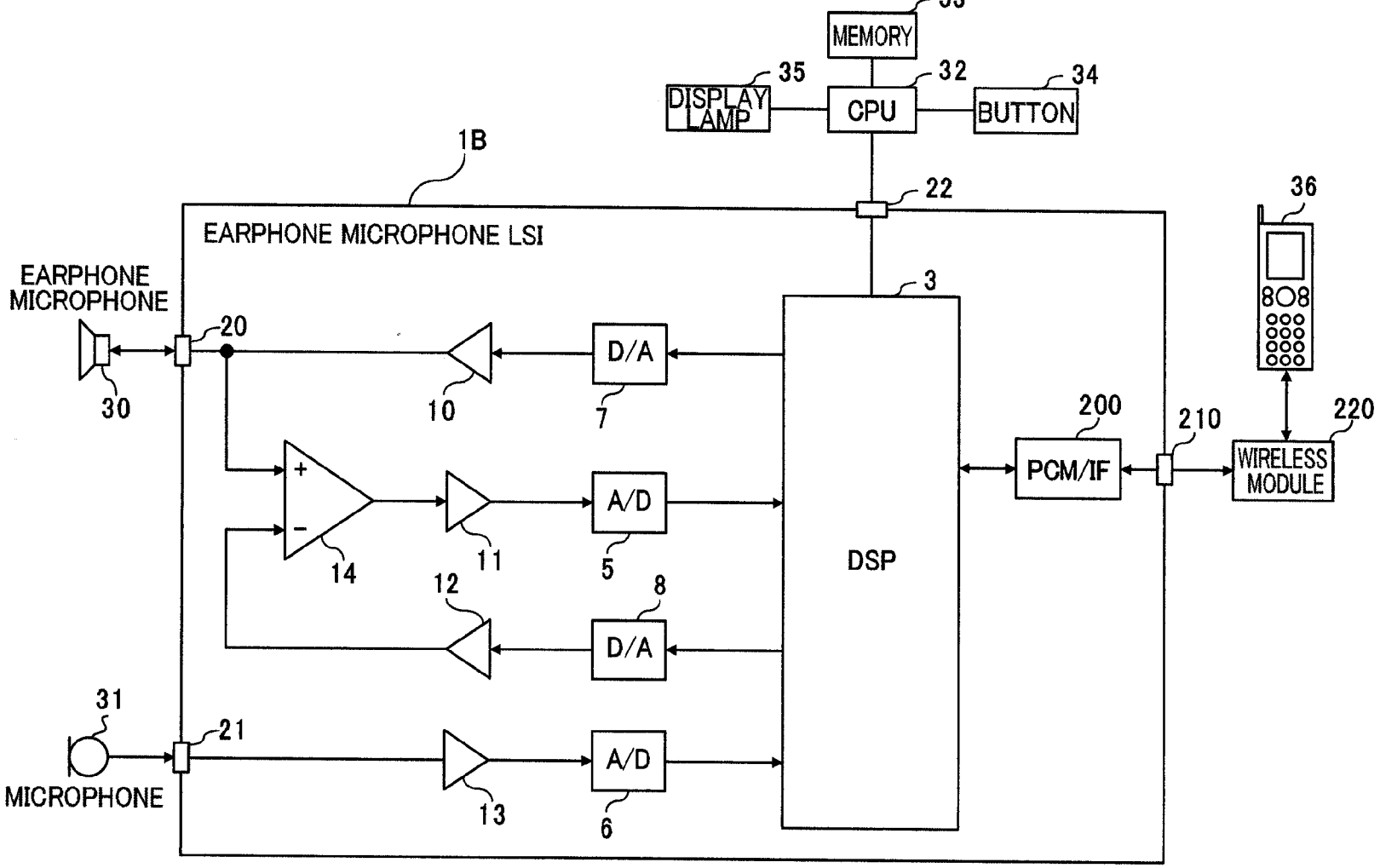
FIG. 11 is a diagram illustrating a configuration of an earphone microphone LSI 1B according to an embodiment of the present invention.

FIG. 11 is a block diagram illustrating a configuration of an earphone microphone LSI 1B according to a second embodiment of the earphone microphone LSI.

Here, it is assumed that a speech signal is output as PCM data from the output signal generation unit 56 of the DSP 3 shown in FIG. 2, and FIR filter 50 performs convolution calculation processing on the basis of PCM data to be input.

A PCM interface circuit 200 is a circuit for sending/receiving PCM data between a wireless module 220 and the DSP 3. Specifically, a speech signal output from the output signal generation unit 56 of the DSP 3 shown in FIG. 2 is transferred to the wireless module 220 through a terminal 210. A speech signal corresponding to the sound from the far end speaker output from the wireless module 220 is transferred to the FIR filter 50.

The wireless module 220 receives the sound of the far end speaker received by the mobile phone 36 as data by radio and transfers the received sound data as PCM data to the PCM interface circuit 200. The wireless module 220 transmits the speech signal output from the PCM interface 200 as PCM data to the mobile phone 36 by radio.

As a result, with a configuration shown in FIG. 11, the sound of the far end speaker is reproduced by the earphone microphone 30. If the output signal generation unit 56A is used in the DSP 3, for example, either the speech signal D1 corresponding to the sound from the earphone microphone 30 or the speech signal D2 corresponding to the sound from the microphone 31 is transmitted as the sound of the user to the far end speaker. As such, communication between the mobile phone 36 and the earphone microphone LSI 1B may be carried out through the wireless module 220 by radio not by wire communication. Also, communication between the DSP 3 and the wireless module 220 may be carried out using an interface circuit capable of transferring sound data, such as the PCM interface circuit 200, for example, not through an AD converter or DA converter.

<Entire Configuration and Third Embodiment of Earphone Microphone LSI>

Figure 12:
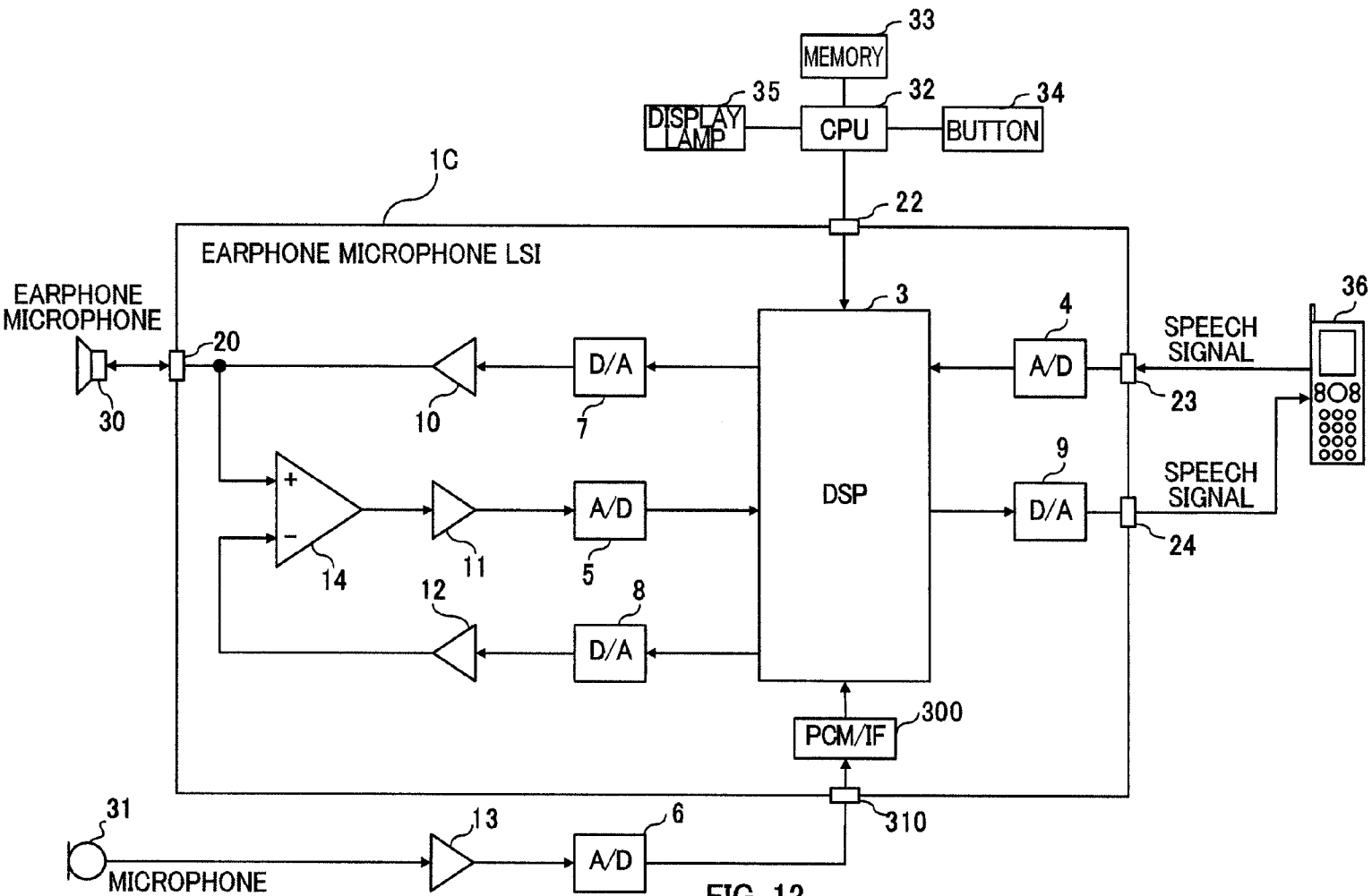
FIG. 12 is a diagram illustrating a configuration of an earphone microphone LSI 1C according to an embodiment of the present invention.

FIG. 12 is a block diagram illustrating a configuration of an earphone microphone LSI 1C according to a third embodiment of the earphone microphone LSI. Here, it is assumed that the AD converter 6 outputs a speech signal from the microphone 31 as PCM data, and the output signal generation unit 56 of the DSP 3 shown in FIG. 2 performs predetermined processing on the basis of the input PCM data.

As a result, with a configuration shown in FIG. 12, the sound of the far end speaker is reproduced by the earphone microphone 30. Also, if the output signal generation unit 56A is used for the output signal generation unit 56, for example, either the speech signal D1 corresponding to the sound from the earphone microphone 30 or the speech signal D2 corresponding to the sound from the microphone 31 is transmitted as the sound of the user to the far end speaker. As such, the amplification circuit 13 and the AD converter 6 may be provided outside the earphone microphone LSI 1C, for example.

<Entire Configuration and Fourth Embodiment of the Earphone Microphone LSI>

Figure 13:
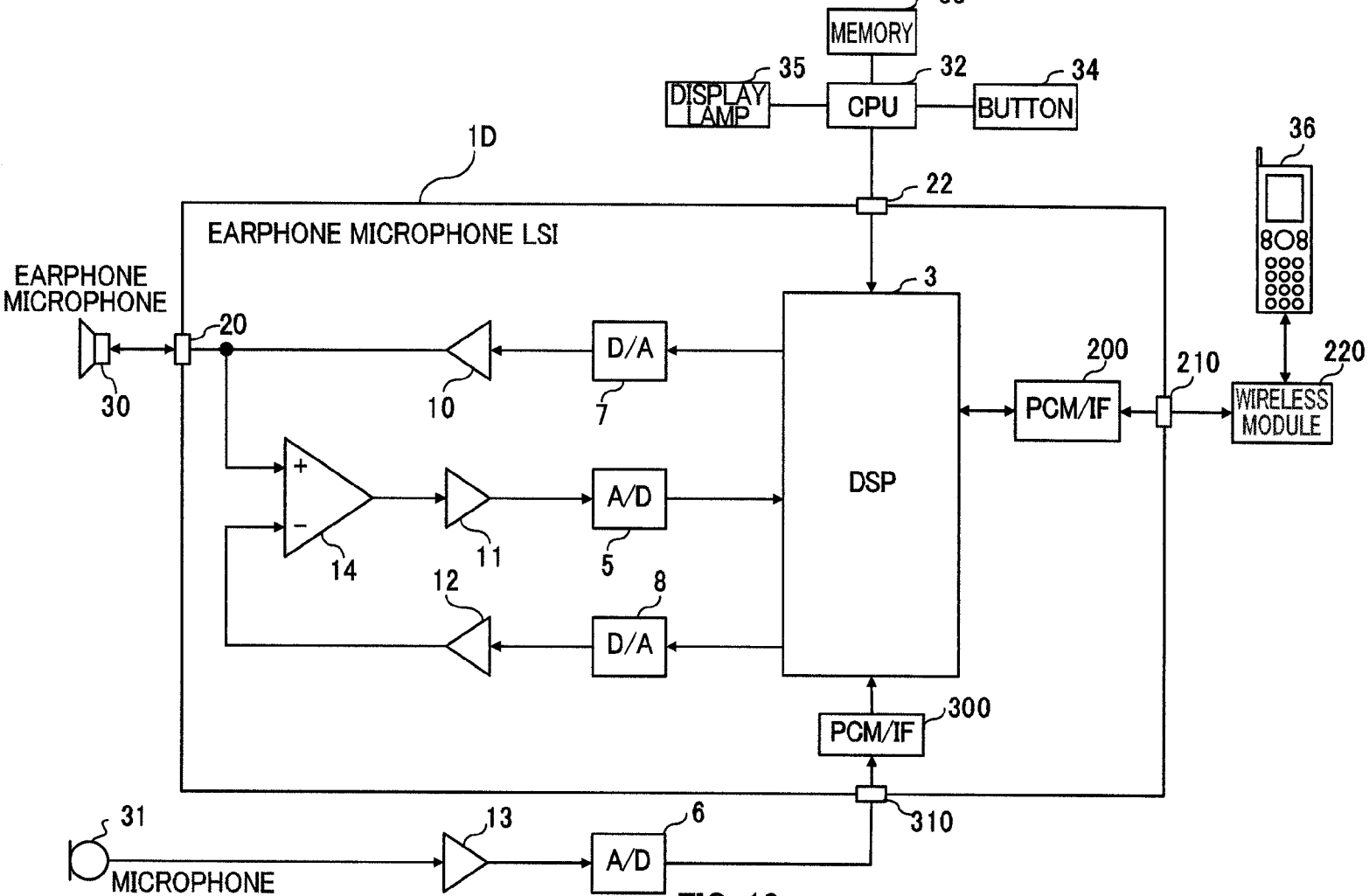
FIG. 13 is a diagram illustrating a configuration of an earphone microphone LSI 1D according to an embodiment of the present invention.

FIG. 13 is a block diagram illustrating a configuration of an earphone microphone LSI 1D according to a fourth embodiment of the earphone microphone LSI.

With a configuration shown in FIG. 13, the sound of the far end speaker is reproduced by the earphone microphone 30. If the output signal generation unit 56A is used for the output signal generation unit 56, for example, either the speech signal D1 corresponding to the sound from the earphone microphone 30 or the speech signal D2 corresponding to the sound from the microphone 31 is transmitted as the sound of the user to the far end speaker. As such, the amplification circuit 13 and the AD converter 6 may be provided outside the earphone microphone LSI 1D, for example, and the PCM interface circuits 200, 300 may be used.

<Entire Configuration and a Fifth Embodiment of the Earphone Microphone LSI>

Figure 14:
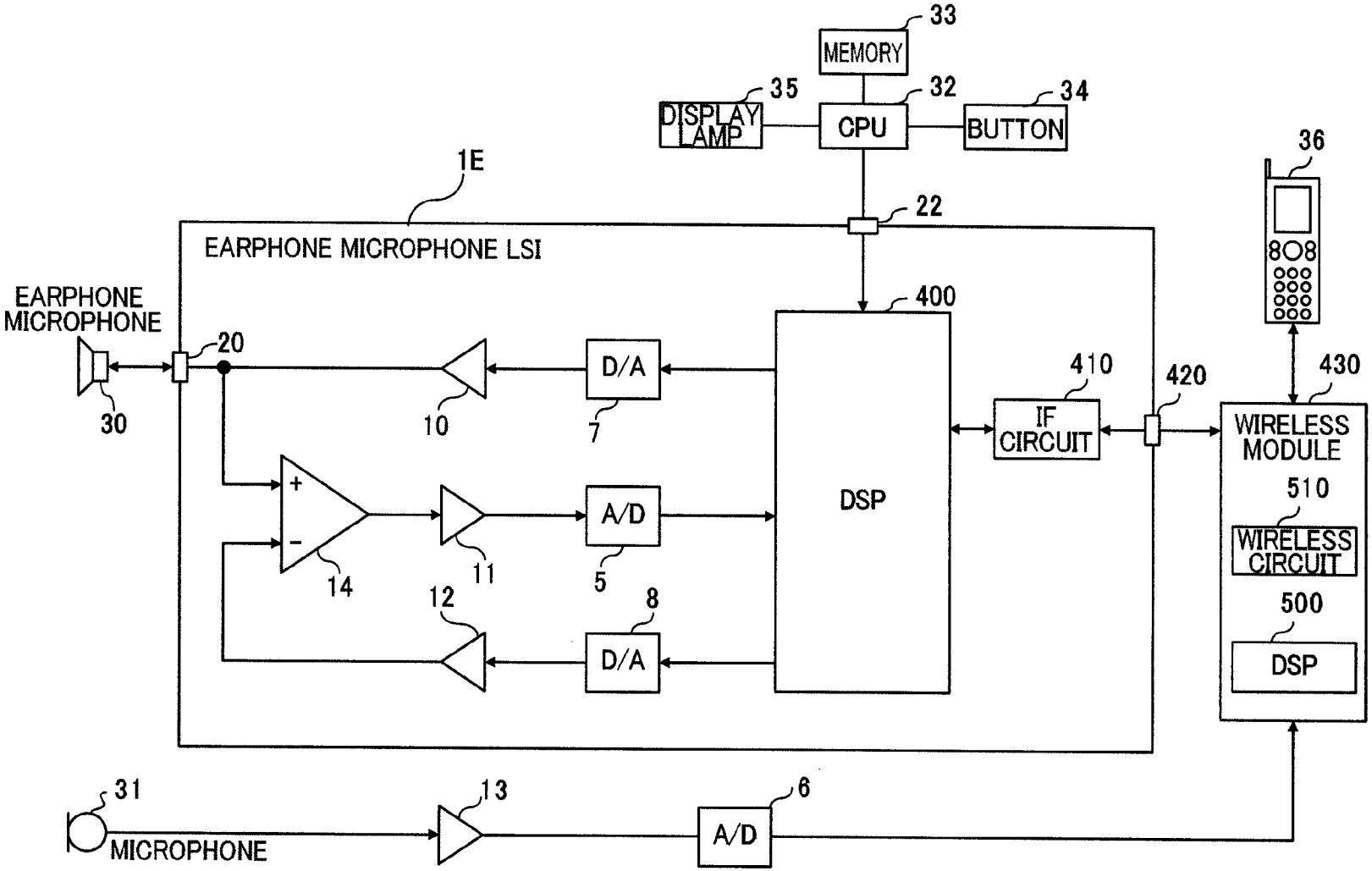
FIG. 14 is a diagram illustrating a configuration of an earphone microphone LSI 1E according to an embodiment of the present invention.

FIG. 14 a block diagram illustrating a configuration of an earphone microphone LSI 1E according to a fifth embodiment of the earphone microphone LSI. Here, it is assumed that the button 34 is used to allow a wireless module 430, which will be described later, to select either the speech signal from the earphone microphone 30 or the speech signal from the microphone 31. The CPU 32 outputs to a DSP 400 an instruction signal corresponding to an operation result of the button 34.

Figure 15:
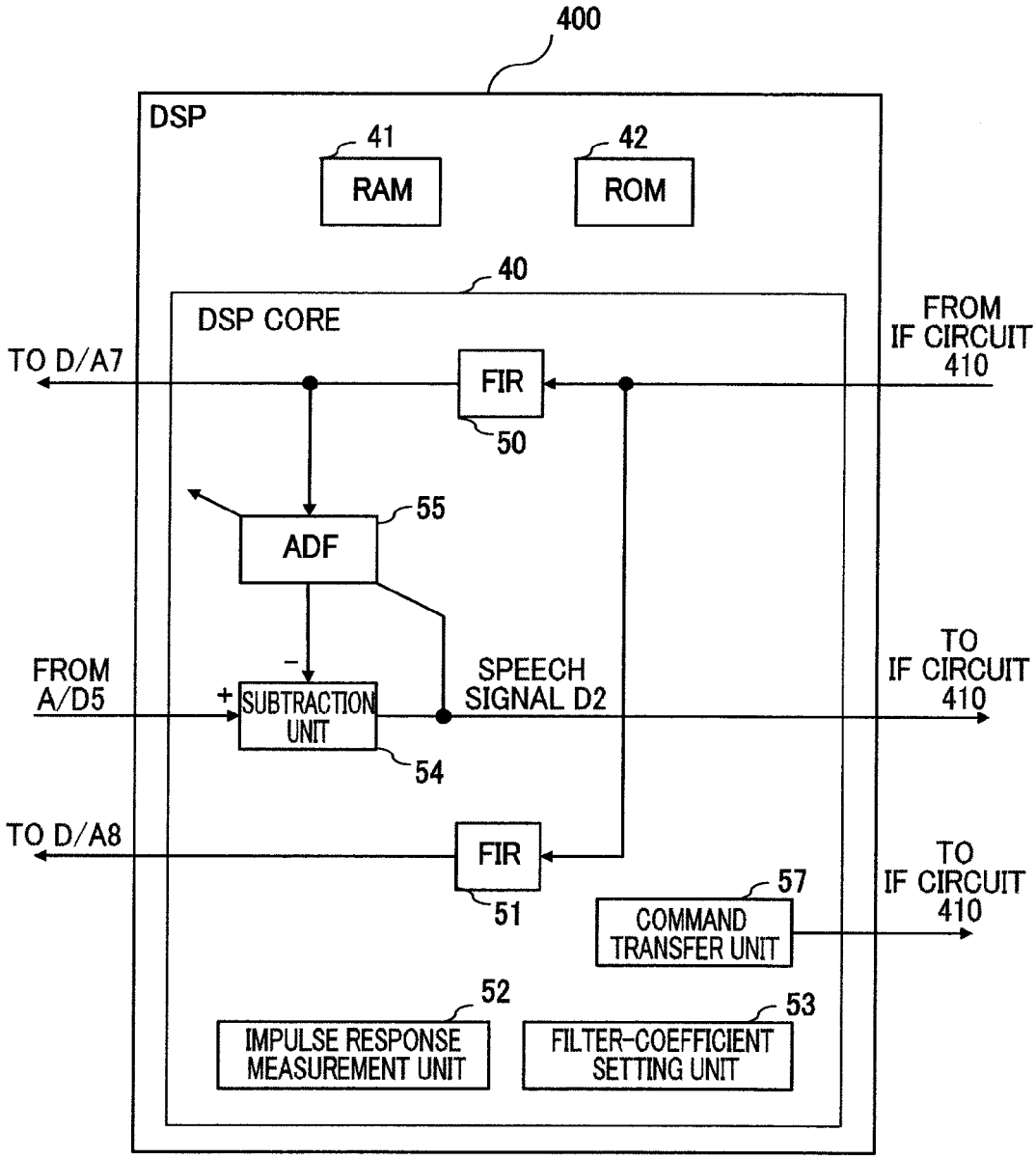
FIG. 15 is a diagram illustrating a configuration of a DSP 400.

A configuration example of the DSP 400 is shown in FIG. 15. When comparing the DSP 400 and the DSP 3 shown in FIG. 2, the DSP 400 does not include the output signal generation unit 56 but includes a command transfer unit 57. The command transfer unit 57 in FIG. 15 transfers to an interface circuit 410, which will be described later, an instruction signal output from the CPU 32 according to the operation result of the button 34.

The interface circuit 410 carries out communication of various data between the DSP 400 and the wireless module 430. Specifically, the interface circuit 410 outputs to the FIR filter 50 a speech signal corresponding to the sound of the far end speaker. The interface circuit 410 transfers to the wireless module 430 an instruction signal from the above mentioned CPU 32 and the speech signal D2 from the earphone microphone 30. Communication between the interface circuit 410 and the wireless module 430 can be carried out through a terminal 420.

The wireless module 430 receives the sound of the far end speaker received by the mobile phone 36 as data by radio as well as transfers the data of the received sound to the interface circuit 410. To the wireless module 430, there are input the speech signal D2 from the earphone microphone 30 output from the interface circuit 410, the instruction signal output from the CPU 32 according to the operation result of the button 34, and the speech signal D1 of the microphone 31 output from the AD converter 6. Then, the wireless module 430 transmits by radio to the mobile phone 36 either one of the speech signal D2 from the earphone microphone 30 and the speech signal D1 from the microphone 31 on the basis of the instruction signal from the CPU 32. That is, if the instruction signal indicating that the user selects the speech signal D2 from the earphone microphone 30 is input to the wireless module 430, for example, the wireless module 430 transmits the speech signal D2 to the mobile phone 36. On the other hand, if the instruction signal indicating that the user selects the speech signal D1 from the microphone 31 is input to the wireless module 430, the wireless module 430 transmits the speech signal D1 to the mobile phone 36. The wireless module 430 according to an embodiment of the present invention includes a DSP 500, which outputs either one of the speech signal D2 and the speech signal D1 to a wireless circuit 510 on the basis of an instruction signal from the CPU 32, and the wireless circuit 510, which carries out data communication with the mobile phone 36 by radio. The DSP 500 includes a speech signal output unit (not shown) for outputting to the wireless circuit 510 either one of the speech signal D2 and the speech signal D1 on the basis of an instruction signal from the CPU 32 as in the case of the DSP 3, for example. In an embodiment of the present invention shown in FIG. 14, the earphone microphone LSI 1E and the DSP 500 correspond to a speech signal processing apparatus, and the command transfer unit 57 corresponds to a selection signal output unit.

As mentioned above, in an embodiment of the present invention shown in FIG. 14, the user can select whether to transmit the speech signal from the earphone microphone 30 to the far end speaker or to transmit the speech signal from the microphone 31 to the far end speaker by operating the button 34.

The earphone microphone LSI 1A according to an embodiment of the present invention having the above-described configuration includes a control signal output unit 61 for outputting such a control signal CONT as to change a logical level according to the noise level Np of the speech signal D1. The speech signal output unit 60 outputs either one of the speech signal D1 and the speech signal D2 according to the logical level of the control signal CONT. Thus, in an embodiment of the present invention, if the noise level around the user becomes higher, for example, the speech signal D2 from the earphone microphone 30 can be output to the speech signal output unit 60, and if the noise level around the user becomes lower, the speech signal D1 from the microphone 31 can be output to the speech signal output unit 60. In general, since the earphone microphone 30 is worn by the user in the ear and detects a sound from the eardrum, the earphone microphone 30 is hardly under an influence of the noise around the user. That is, in an embodiment of the present invention, if the noise level around the user becomes higher, the speech signal D2 under less influence of the noise can be transmitted to the far end speaker. On the other hand, the sound output from the eardrum in general is different in frequency characteristics from the sound uttered from the mouth, and the sound output from the eardrum becomes a so-called inward sound. In an embodiment of the present invention, if the noise level around the user becomes lower, the speech signal D1 corresponding to the sound generated from the mouth can be transmitted to the far end speaker. As such, the earphone microphone LSI 1A according to an embodiment of the present invention can output the speech signal with a good sound quality according to the noise around the user.

Moreover, the signal output unit 73 of the control signal output unit 61A according to an embodiment of the present invention may be so configured as to change the control signal CONT on the basis of the comparison result of the comparison unit 71, for example. That is, it may be so configured that, the signal output unit 73 outputs the control signal CONT of the H-level on the basis of the comparison result indicating that the noise level Np is higher than the threshold value P1, and the signal output unit 73 outputs the control signal CONT of the L-level on the basis of the comparison result indicating that the noise level Np is lower than the threshold value P1, for example. In such configuration, if the noise level around the user becomes higher and the calculated noise level Np becomes higher than the threshold value P1, the speech signal D2 under less influence of the noise can be transmitted to the far end speaker. On the other hand, if the noise level around the user becomes lower and the calculated noise level Np becomes lower than the threshold value P1, the speech signal D1 with a good sound quality can be transmitted to the far end speaker. As such, the noise level Np and the threshold value P1 are compared, so that the control signal output unit 61A can output a speech signal with a good sound quality according to the noise around the user.

Furthermore, the noise-level calculation unit 70 according to an embodiment of the present invention calculates the short-time power Pt on the basis of the speech signal D1 corresponding to the sound from the microphone 31. When the short-time power Pt is calculated, if the sound uttered by the user or the like is input to the microphone 31, for example, the level of the short-time power Pt might become greater. Also, if the short-time power Pt is calculated under the influence of the sound of the user or the like, the noise level Np might become greater in value than the actual level of the noise around the user. Thus, in an embodiment of the present invention, if the noise level Np becomes greater than the threshold value P1, the control signal CONT of the H-level is not immediately output but the control signal CONT of the H-level is output only if the count value of the count unit 72 exceeds the predetermined count value C. That is, if the number of times that the noise level Np becomes greater than the threshold value P1 on a consecutive basis exceeds C number of times, the control signal CONT of the H-level is output. Thus, even if the noise level Np is temporarily raised by the sound uttered by the user or the like, the output signal generation unit 56A does not output the speech signal D2 as long as the noise level around the user does not become higher. By employing such configuration, the output signal generation unit 56A can accurately output the speech signal with a good sound quality according to the noise around the user.

Furthermore, the output signal generation unit 56B according to an embodiment of the present invention includes the minimum value calculation unit 75 for calculating the minimum value Pmin of the noise level Np and the control signal generation unit 76 for changing the control signal CONT on the basis of the minimum value Pmin. The minimum value Pmin of the noise level Np in the predetermined time period T1 is generally higher in the level of the sound uttered by the user than in the noise level around the user. Thus, the minimum value Pmin becomes a value corresponding to the noise level. Therefore, if the noise level becomes higher, the minimum value Pmin is also raised, while if the noise level becomes lower, the minimum value Pmin is also lowered. Therefore, the control signal CONT is changed in level on the basis of the minimum value Pmin, so that the output signal generation unit 56B can accurately output the speech signal with a good sound quality according to the noise around the user.

Furthermore, the output signal generation unit 56C according to an embodiment of the present invention includes the coefficient calculation unit 91 for calculating such a coefficient β as to become greater if the noise level Np becomes greater, and such a coefficient (1−β) as to become smaller if the noise level Np becomes greater. From the speech signal output unit 90, there is output the speech signal D3=speech signal D2×β+speech signal D1×(1−β). Therefore, for example, if the noise level around the user becomes higher, the proportion of the speech signal D2 corresponding to the sound of the earphone microphone 30 becomes greater in the speech signal D3 output from the speech signal output unit 90. On the other hand, if the noise level around the user becomes lower, the proportion of the speech signal D1 corresponding to the sound of the microphone 31 becomes greater in the speech signal D3. That is, if the noise level is higher, the speech signal D2 under less influence of the noise is output more, and if the noise level is lower, the speech signal D1 with a good sound quality is output more. Thus, the output signal generation unit 56C can output the speech signal with a good sound quality according to the noise around the user.

Furthermore, with the earphone microphone LSI 1E in an embodiment of the present invention, the user can select whether to transmit the speech signal D2 from the earphone microphone 30 to the far end speaker or to transmit the speech signal D1 from the microphone 31 to the far end speaker by operating the button 34. Specifically, the command transfer unit 57 outputs an instruction signal output from the CPU 32 according to the operation result of the button 34. Then, the speech signal output unit (not shown) of the DSP 500 outputs to the wireless circuit 510 either the speech signal D1 or the speech signal D2 on the basis of the above-mentioned instruction signal. Thus, for example, if the noise level around the user becomes higher, the user can select the speech signal D2, and if the noise level around the user becomes lower, the user can select the speech signal D1, and therefore, a call with a good sound quality can be realized.

The above embodiments of the present invention are simply for facilitating the understanding of the present invention and are not in any way to be construed as limiting the present invention. The present invention may variously be changed or altered without departing from its spirit and encompass equivalents thereof.

In an embodiment of the present invention, the earphone microphone 30 is used as such a microphone that the user is hardly affected by the noise, but a bone-conduction microphone or any other input means may be used, for example. If the bone-conduction microphone is used as the input means, it may be so configured that bone-conducted sound generated from the bone-conduction microphone is input to the terminal 20 in FIG. 1, for example, and the speech signal from the far end speaker output from the terminal 20 is input to the bone-conduction microphone. The bone-conducted sound output from the bone-conduction microphone is the same analog electric signal as that of the speech signal output from the above-mentioned earphone microphone 30. Also, since the bone-conducted sound is generated on the basis of vibration of a skull bone or the like when the user utters the sound, it is hardly affected by the sound around the user in general. Also, if the speech signal according to the sound from the far end speaker is input to the bone-conduction microphone, the bone-conduction microphone allow the user to recognize the sound by vibration of the ear bone, the skull bone and the like of the user wearing it. As such, though the earphone microphone 30 and the bone-conduction microphone are different from each other in a mechanism of generating and reproducing a speech signal, they are common in a point that both of them are hardly affected by the noise around the user. Therefore, even if the bone-conduction microphone is used instead of the earphone microphone 30, the same effect can be obtained as in the case of an embodiment of the present invention. Another input means include a body-conduction microphone, for example. Even if the body-conduction microphone is used, it is possible to employ the same configuration as in the case of the bone-conduction microphone, and thus, the same effect can be obtained as in the case of an embodiment of the present invention.

Moreover, in an embodiment of the present invention, the noise-level calculation unit 70 calculates the noise level on the basis of the speech signal D1, but this is not limitative. The noise level may be calculated on the basis of those hardly affected by the noise such as the speech signal D2 corresponding to the sound from the earphone microphone 30, for example.

What is claimed is:

1. A speech signal processing apparatus comprising:

a control signal output unit configured to receive as an input signal either one of a first speech signal corresponding to a sound uttered by a user and a second speech signal corresponding to a sound output from an eardrum of the user when the user utters a sound, and output a control signal corresponding to a noise level of the input signal; and a speech signal output unit configured to output either one of the first speech signal and the second speech signal according to the control signal, wherein the control signal output unit includes:

a noise-level calculation unit configured to calculate a noise level of the input signal; and a control signal generation unit configured to generate the control signal for allowing the speech signal output unit to output the second speech signal when the noise level is higher than a predetermined level, and generate the control signal for allowing the speech signal output unit to output the first speech signal when the noise level is lower than the predetermined level, and wherein the control signal generation unit includes:

a comparison unit configured to output a comparison signal corresponding to a comparison result each time the noise level and a predetermined level are compared; and a generation unit configured to generate the control signal for allowing the speech signal output unit to output the second speech signal when the comparison unit outputs, a predetermined number or more on a consecutive basis, the comparison signal indicating that the noise level is higher than the predetermined level, and generate the control signal for allowing the speech signal output unit to output the first speech signal when the comparison unit does not output, the predetermined number or more on the consecutive basis, the comparison signal indicating that the noise level is higher than the predetermined level.

2. A speech signal processing apparatus comprising:

a control signal output unit configured to receive as an input signal either one of a first speech signal corresponding to a sound uttered by a user and a second speech signal corresponding to a sound output from an eardrum of the user when the user utters a sound, and output a control signal corresponding to a noise level of the input signal; and a speech signal output unit configured to output either one of the first speech signal and the second speech signal according to the control signal, wherein the control signal output unit includes:

a noise-level calculation unit configured to calculate a noise level of the input signal;

a minimum value calculation unit configured to calculate a minimum value of the noise level in a predetermined time period; and a control signal generation unit configured to generate the control signal for allowing the speech signal output unit to output the second speech signal when the minimum value is higher than a predetermined value and generate the control signal for allowing the speech signal output unit to output the first speech signal when the minimum value is lower than the predetermined value.

3. A speech signal processing apparatus comprising:

a noise-level calculation unit configured to receive as an input signal either one of a first speech signal corresponding to a sound uttered by a user and a second speech signal corresponding to a sound output from an eardrum of the user when the user utters a sound, and calculate a noise level of the input signal;

a coefficient calculation unit configured to calculate such a first coefficient as to become smaller according to an increase of the noise level and such a second coefficient as to become greater according to the increase of the noise level; and a speech signal output unit configured to output a sum of a product of the first coefficient and the first speech signal and a product of the second coefficient and the second speech signal.

4. A speech signal processing apparatus comprising:

a control signal output unit configured to output a control signal corresponding to an operation result of an operation unit configured to be operated so as to select either one of a first speech signal corresponding to a sound uttered by a user and a second speech signal corresponding to a sound output from an eardrum of the user when the user utters a sound; and a speech signal output unit configured to output either one of the first speech signal and the second speech signal according to the control signal.

* * * * *